US008471455B2

(12) United States Patent
Mora et al.

(10) Patent No.: US 8,471,455 B2
(45) Date of Patent: Jun. 25, 2013

(54) POSITIONING OF AUXILIARY AMALGAM

(75) Inventors: Peter Mora, Budapest (HU); Laszlo Bankuti, Budapest (HU); Peter Lucz, Budapest (HU)

(73) Assignee: General Electric Company, Schenectady, NY (US)

( * ) Notice: Subject to any disclaimer, the term of this patent is extended or adjusted under 35 U.S.C. 154(b) by 343 days.

(21) Appl. No.: 12/694,415

(22) Filed: Jan. 27, 2010

(65) Prior Publication Data

US 2011/0181176 A1 Jul. 28, 2011

(51) Int. Cl.
*H01J 1/62* (2006.01)

(52) U.S. Cl.
USPC ..... 313/490; 445/26

(58) Field of Classification Search
USPC ..... 313/483–493, 623, 627–643, 567, 313/111–117, 25–27, 317, 318.01–318.09; 439/615, 739; 445/24, 26, 29, 22
See application file for complete search history.

(56) References Cited

U.S. PATENT DOCUMENTS

| | | | | |
|---|---|---|---|---|
| 3,336,502 | A * | 8/1967 | Gilliatt | 315/108 |
| 3,634,717 | A * | 1/1972 | Boucher et al. | 313/552 |
| 5,006,755 | A * | 4/1991 | Wittmann et al. | 313/546 |
| 5,717,290 | A * | 2/1998 | Shaffer | 313/545 |
| 5,739,633 | A | 4/1998 | Biro et al. | |
| 7,180,232 | B2 | 2/2007 | De Man et al. | |
| 2006/0006784 | A1 | 1/2006 | Takahara et al. | |
| 2010/0134000 | A1 * | 6/2010 | Carter et al. | 313/552 |
| 2011/0074277 | A1 * | 3/2011 | Speer et al. | 313/490 |

FOREIGN PATENT DOCUMENTS

| | | | |
|---|---|---|---|
| EP | 0667636 | A2 | 8/1995 |
| EP | 0 895 654 | B1 | 8/2002 |
| GB | 1097090 | A | 12/1967 |

OTHER PUBLICATIONS

PCT Search Report issued in connection with corresponding WO Patent Application No. US11/020748 filed on Jan. 11, 2011.

* cited by examiner

*Primary Examiner* — Donald Raleigh
(74) *Attorney, Agent, or Firm* — Fay Sharpe LLP

(57) ABSTRACT

A fluorescent lamp includes a discharge tube and an auxiliary amalgam assembly held in the discharge tube by a holder. The holder has first and second regions with attaching portions adapted to receive an associated attachment member. The holder has a first dimension prior to disposition in the discharge tube.

8 Claims, 5 Drawing Sheets

POSITIONING OF AUXILIARY AMALGAM

BACKGROUND OF THE DISCLOSURE

The present disclosure relates generally to a low pressure mercury vapor discharge lamp and more particularly to a compact fluorescent lamp including an auxiliary amalgam for emitting mercury vapor during at least a starting period.

A wide variety of low-pressure discharge lamps are known in the art. Low pressure mercury vapor discharge lamps have a maximum efficiency of converting supplied electrical energy into ultraviolet radiation at an optimal mercury vapor pressure. The mercury vapor pressure is typically very highly dependent on the operating temperature of the lamp. Compact fluorescent lamps, which have bent tubes forming convoluted discharge paths, typically have high loads at the walls and therefore high temperatures are reached at the wall during operation of the lamp, typically about 70 to about 140 degrees Centigrade (C). At these high temperatures the vapor pressure of the mercury can increase above the optimal.

To control the mercury vapor pressure near the optimal level, an amalgam is used in place of conventional liquid mercury. As the mercury vapor pressure in the lamp increases to an undesirable level, the amalgam begins to melt and form a solution with mercury vapor to decrease the mercury vapor pressure in the lamp back toward the optimal level. The location of the amalgam, which has a predetermined melting temperature, it important in providing the desired improvement because the location of the amalgam affects its temperature during operation of the lamp. The amalgam typically used in areas near high temperature walls is bismuth-indium-mercury (Bi—In—Hg).

Lamps using an amalgam optimized for use in high temperature areas have the disadvantage of a longer warm-up or starting period than lamps suing pure liquid mercury. The length of the starting period is dependent on the speed at which the mercury vapor pressure in the lamp increases because the lumen output of the lamp is dependent on the mercury vapor pressure in the lamp. The starting period is longer for amalgam containing lamps because the mercury vapor pressure is too low at lower temperatures usually present at start-up, typically in the range of about 0 degrees C. to about 50 degrees C. The mercury vapor pressure increases slowly and doesn't reach its proper level until the amalgam reaches the high temperatures. In contrast, the mercury vapor pressure of a liquid mercury dosed lamp is much higher than the mercury vapor pressure of the amalgam containing lamp at the lower temperature or at room temperature.

To improve warm-up characteristics of an amalgam containing lamp, an auxiliary amalgam is typically attached to each electrode stem so that the auxiliary amalgam emits mercury during the starting period. The auxiliary amalgam is heated by the cathode after ignition and emits mercury vapor to make up for the lack of mercury vapor during the starting period. The auxiliary amalgam typically used is indium-mercury (In—Hg). The amalgam which controls the mercury vapor pressure during operation, except for the starting period, is typically called the main amalgam, in contrast with the auxiliary amalgam which controls the mercury vapor pressure during the starting period.

Amalgams containing low pressure mercury vapor discharge lamps have experienced varying degrees of success. Thus, a need exists for an improved low-pressure mercury vapor discharge lamp having improved warm-up characteristics.

SUMMARY OF THE DISCLOSURE

In one aspect, the present disclosure relates to a compact fluorescent lamp that includes a discharge tube. An auxiliary amalgam assembly is held in the discharge tube by a holder having first and second regions with attaching portions adapted to receive an associated attachment member. The holder has a first dimension prior to disposition in the discharge tube. Upon disposition in the discharge tube, the holder has a second dimension different than the first dimension.

In another aspect, the present disclosure relates to a method of positioning an auxiliary amalgam in a compact fluorescent lamp that includes providing a discharge tube having an opening defined by a cross-sectional first dimension. An auxiliary amalgam assembly is additionally provided having a second dimension in a relaxed, unbiased state larger than the first dimension. A reduced second dimension of the auxiliary amalgam less than the first dimension allows for disposing the auxiliary amalgam assembly in the discharge tube. The method further includes causing the auxiliary amalgam assembly to increase its second dimension subsequent to disposition in the discharge tube. In order to reduce the second dimension, the first providing step includes using a wire or fiber.

In one aspect, the present disclosure relates to compact fluorescent lamp that includes a discharge tube having an inner wall to form a chamber. The lamp further includes an auxiliary amalgam assembly for engagement with the inner wall in the discharge tube arrangement. A portion of the auxiliary amalgam assembly includes a magnetic material.

In another aspect, the present disclosure relates to a method of positioning an auxiliary amalgam in a compact fluorescent lamp that includes providing a discharge tube having an inner wall forming a chamber. An auxiliary amalgam assembly for engaging with the inner wall in the discharge tube is also provided. A portion of the auxiliary amalgam assembly includes a material that is attracted by a magnetic material.

A primary benefit of the present disclosure is a more precise positioning of an auxiliary amalgam in a fluorescent lamp.

Another benefit is an improved compact fluorescent lamp with decreased warm-up time during the service life of the lamp.

Still further advantages will become apparent to those of ordinary skill in the art upon reading and understanding the following detailed description of the preferred embodiment.

DETAILED DESCRIPTION OF THE PREFERRED EMBODIMENTS

Figure 1:
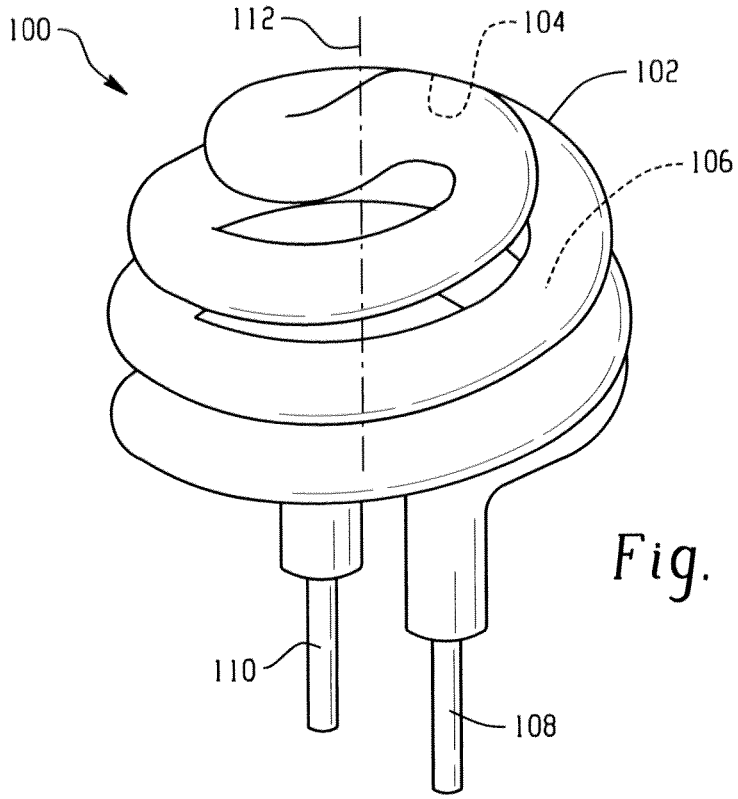
FIG. 1 is a perspective view of a conventional compact fluorescent lamp.

FIG. 1 illustrates a fluorescent lamp such as a compact fluorescent lamp 100. The lamp 100 includes a sealed discharge tube or a light transmissive envelope 102, preferably formed of a material which is transmissive to radiation in the visible range and may also be transmissive to radiation in the IR range. Suitable materials for forming the envelope 102 include transparent materials such as quartz glass, and other vitreous materials, although translucent materials, such as ceramic materials, are also contemplated. The discharge tube 102 has an inner wall 104 which encloses a sealed volume or discharge chamber 106. As illustrated in FIG. 1, the discharge tube 102 is a single tube with substantially straight ends or end sections 108, 110 and an intermediate portion has a coiled or spiral configuration wound about a principal axis 112 of the lamp to provide a substantially homogeneous illumination. At the ends 108, 110 of the discharge tube path, the tube is provided with cathodes (not shown) and lead-in wires (not shown) connected to the cathodes. The lead-in wires of the discharge tube are connected to a ballast unit (not shown) for controlling the current in the discharge tubes.

In another embodiment, the discharge tube arrangement may be comprised of straight tube members with a longitudinal axis substantially parallel to the principal axis of the fluorescent lamp, in which the neighboring tube members are connected to each other in series to form a continuous arc path. In yet another embodiment, configurations may include two, four or six individual discharge tube members depending on the required output luminous intensity. The discharge tube arrangement may also comprise two individual, elongated discharge tube members bent to a generally U-shape of substantially the same length, which are interconnected by bridge portions to form a continuous arc path. In still another embodiment, configurations may include one or three individual discharge tubes bent in a generally U-shape depending on the required output luminous intensity. The U-shaped discharge tube members may comprise substantially parallel straight sections defining the length of the discharge tube arrangement and a curved middle section.

In order to provide visible light, an internal surface of the discharge tubes is covered with a fluorescent phosphor layer (not shown). This phosphor layer is within the sealed discharge volume. The composition of such a phosphor layer is known per se. This phosphor layer converts the short wave, mainly UVC radiation into longer wave radiation in the spectrum of visible light. The phosphor layer is applied to the inner surface of the discharge tube before the tube is sealed.

A gaseous discharge fill or fill gas is contained within the discharge chamber 106. The fill gas typically includes a noble gas such as argon or a mixture of argon and other noble gases such as xenon, krypton, and neon and is responsible for the arc voltage, that is, they set up the mean free path of the electrons. The noble gases may have only an indirect and a small influence on the mercury vapor pressure of the lamp 100.

A main amalgam member (not shown) is provided within the discharge tube 102 and is oftentimes located in the first and second ends 108, 110. Typically, the amalgam is a metal alloy such as an alloy containing a bismuth-indium-mercury (Bi—In—Hg) composition. The main amalgam may also contain tin, zinc, silver, gold and combinations thereof. The particular composition is chosen to be compatible with the operating temperature characteristic of the location in the tube 102. As such, the alloy is generally ductile at temperatures of about 100° C. The alloy may become liquid at higher lamp operating temperatures. Once the main amalgam reaches working temperature the mercury vapor pressure during lamp operation stabilizes by absorbing mercury vapor.

Figure 2:
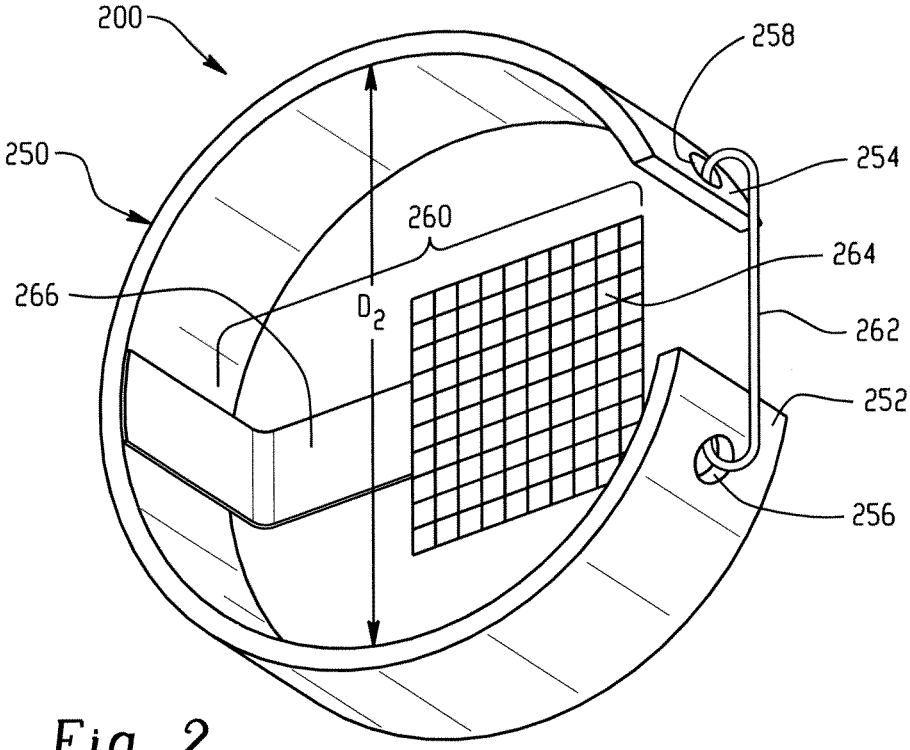
FIG. 2 is a perspective view of an auxiliary amalgam assembly in accordance with an exemplary embodiment.

With regard to FIG. 2, an auxiliary amalgam assembly 200 is shown. In an embodiment, an auxiliary amalgam assembly 200 includes a holder 250 having first and second regions 252, 254. Typically, the holder 250 is composed of a flexible metal magnetic material such as manganese, iron, cobalt, nickel, alloys thereof and combinations thereof. Although, other flexible metal magnetic type materials may be suitable. The first and second regions 252, 254 further include attaching portions 256, 258 adapted to receive an associated attachment member 260. A preferred form of the holder 250 has a generally C-shape with an opening at each end forming the attaching portions 256, 258. However, other configurations may prove suitable. The attaching portions 256, 258 are formed for receipt of an associated wire or fiber.

The associated attachment member 260 is an auxiliary amalgam member. Specifically, the auxiliary amalgam member is a generally planar wire mesh member 264 such as a rectangular or square component attached to the holder 250 by a planar-like or wire-like member 266. Of course one skilled in the art will recognize that the generally planar wire mesh member 264 can vary in shape and size. The auxiliary amalgam member 260 is shaped like, and generally described as, a "flag-shaped" auxiliary amalgam assembly. However, other configurations may prove suitable without departing from the scope and intent of the present disclosure.

The auxiliary amalgam member 260 controls the mercury vapor pressure during a starting period of the lamp. Impacting electrons heat up the auxiliary amalgam member 260 which is located in the path of the arc discharge enough to generate mercury vapor during the starting period. Enough vapor is generated to increase the mercury vapor pressure in the discharge lamp and thereby improve warm up characteristics of, for example, lamp 100. The auxiliary amalgam member 260 also absorbs mercury during non-discharge period, i.e., when the temperature is reduced at the cathode which is in a non-discharge state during this period.

Figure 3:
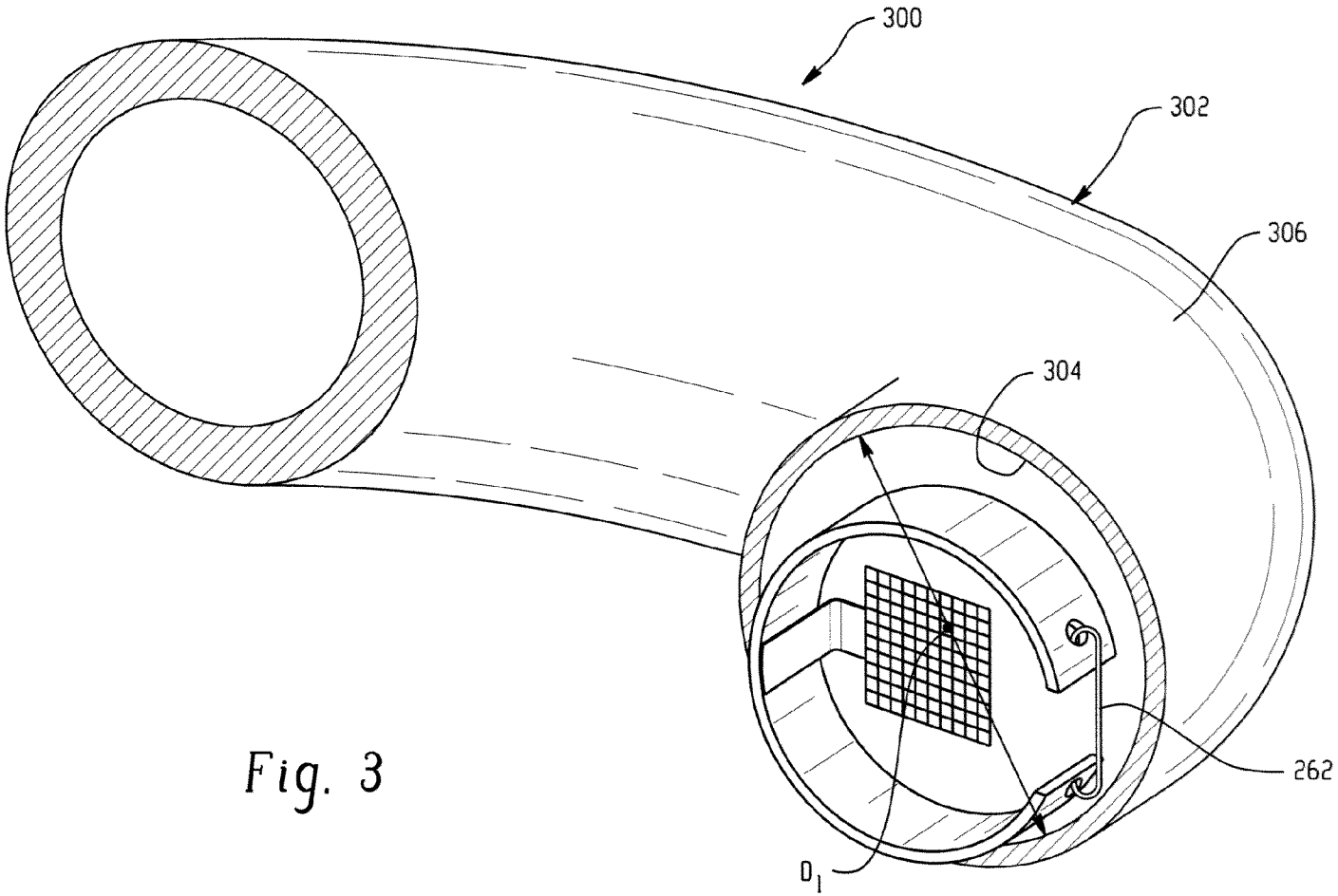
FIGS. 3-5 is an enlarged perspective view in cross-section of a compact fluorescent lamp including an auxiliary amalgam assembly in accordance with an exemplary embodiment.

With regard to FIGS. 3-5 and 7, a partial cross-sectional view of a compact fluorescent lamp 300 is shown. It is to be appreciated that lamp 300 includes many similar features as previously described in connection with lamp 100 so that like reference numerals and components in the "300" series refer to like numerals and components in the "100" series of the FIG. 1 embodiment. In this exemplary embodiment, a method of positioning an auxiliary amalgam is provided. In FIG. 3, a discharge tube 302 includes an opening defined by a cross-sectional first dimension $D_1$. As illustrated in FIG. 2, an auxiliary amalgam assembly 260 has a second dimension $D_2$ in a relaxed, unbiased state which is larger than the first dimension $D_1$. With regard to FIG. 3, the second dimension $D_2$ of the auxiliary amalgam assembly 260 is reduced less than the first dimension $D_1$ using a wire or fiber 262 so that it may be positioned in the discharge tube 302.

Figure 4:
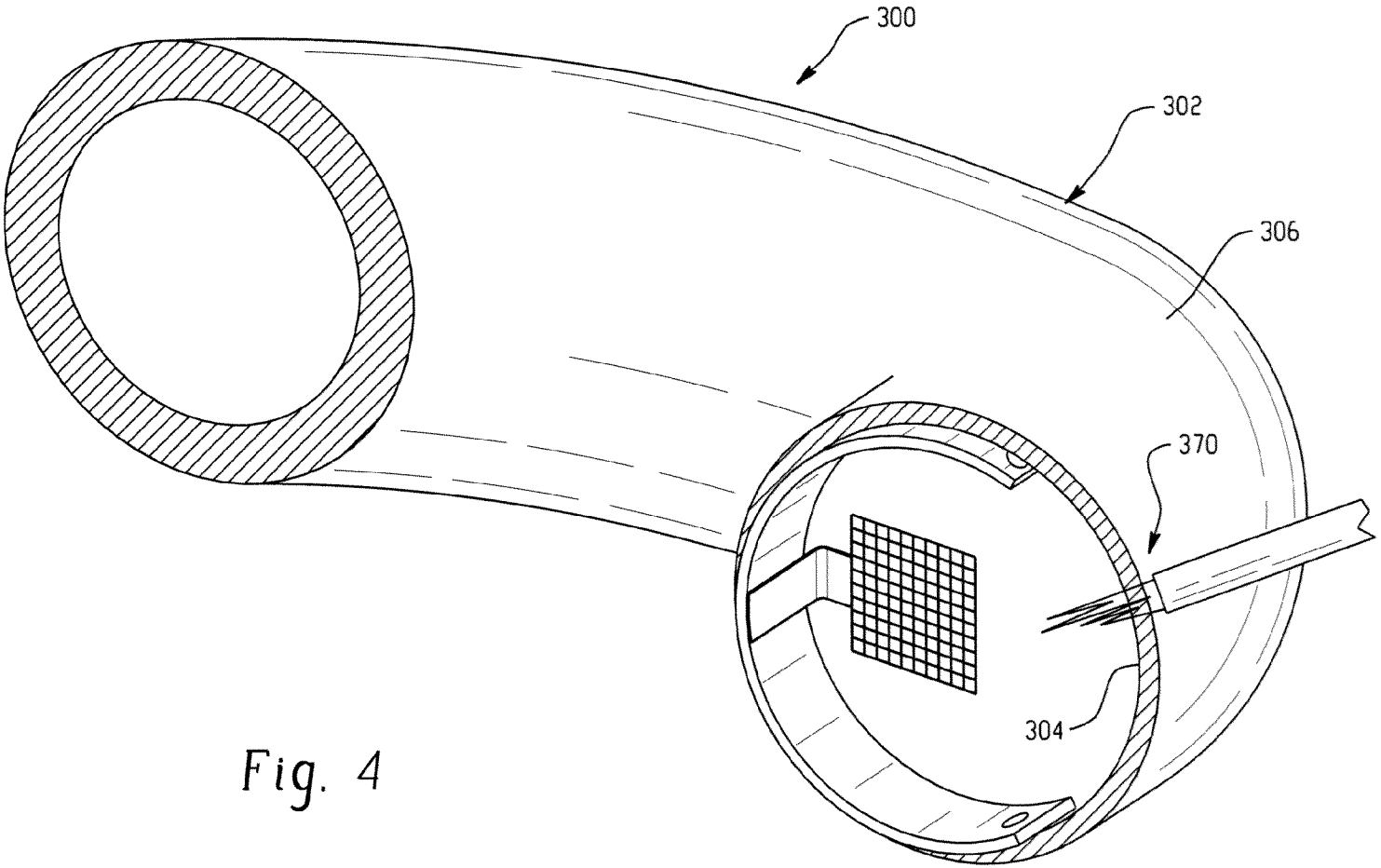

In FIG. 4, in this preferred arrangement, the wire or fiber 262, no longer shown, is released by using heat as represented by flame 370 or a magnetic field or a magnetic material causing the auxiliary amalgam assembly 260 to increase to its second dimension $D_2$ subsequent to disposition in the discharge tube 302 conforming within the discharge chamber wall 304. However, other similar methods of releasing the wire or fiber 262 may be used without departing from the scope and intent of the present disclosure.

Figure 5:
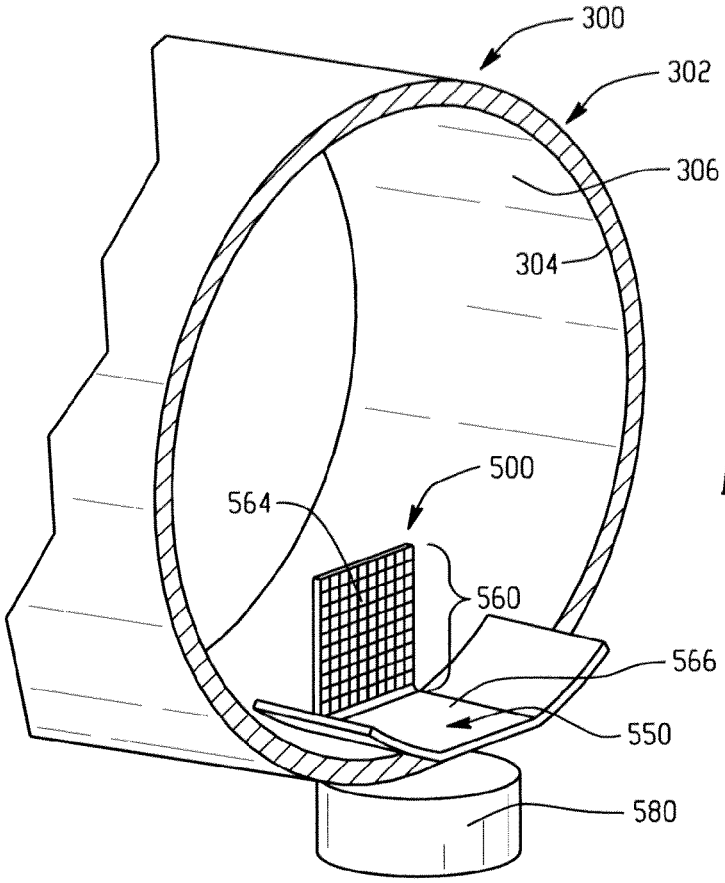

In FIG. 5, the auxiliary amalgam assembly 500 includes a holder 550 having a generally planar-like flexible shape for conforming to the discharge chamber wall 304. Typically, as described above, the holder 550 is composed of a flexible metal magnetic material such as manganese, iron, cobalt, nickel, alloys thereof, and combinations thereof. Although, other flexible metal magnetic type materials may be suitable.

The associated attachment member 560 is an auxiliary amalgam member. As described above, the auxiliary amalgam member is a generally planar wire mesh member 564 such as a rectangular or square component attached to the holder 550 by a planar-like member 566. A permanent magnet 580 is located externally adjacent the discharge tube for positioning the auxiliary amalgam assembly 500 within the discharge chamber wall 304.

Figure 6:
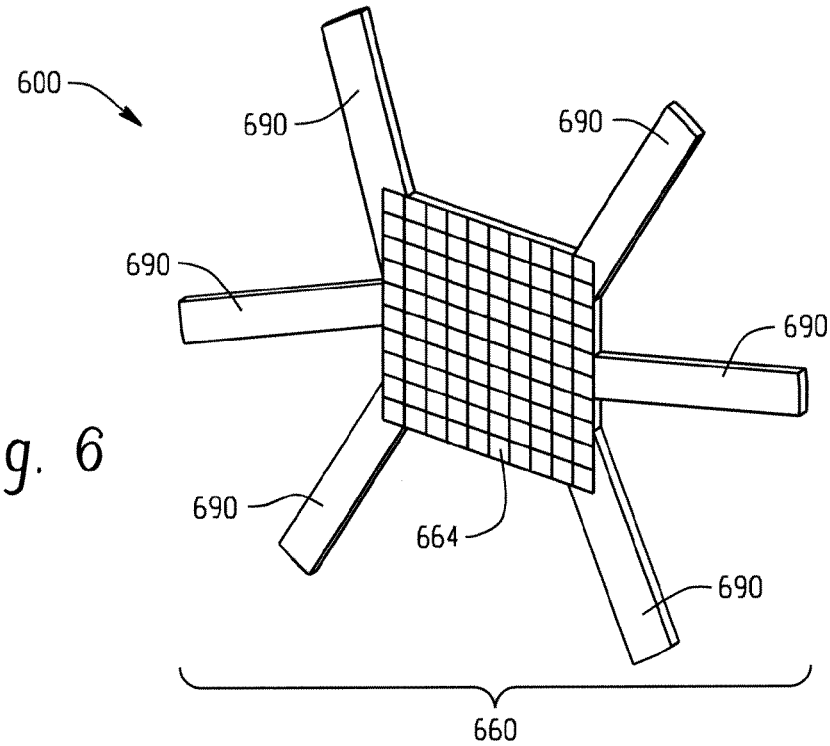
FIG. 6 is a perspective view of an auxiliary amalgam assembly in accordance with an exemplary embodiment.

With regard to FIG. 6, an auxiliary amalgam assembly 600 is shown. In an embodiment, an auxiliary amalgam assembly 600 includes a plurality of holders 690. The number of holders may be at least four, and generally less than about ten, e.g. six. The holders are dimensional to extend between the mesh member 664 and a inner surface of the discharge tube to fix or locate the auxiliary amalgam in the lamp assembly. The plurality of holders 690 may have the shape of finger-like or wire-like projections, although other configurations may be suitable. Typically, as described above, the plurality of holders 690 are composed of a flexible metal magnetic material such as manganese, iron, cobalt, nickel, alloys thereof, and combinations thereof. However, other flexible metal magnetic material type materials may be suitable.

Figure 7:
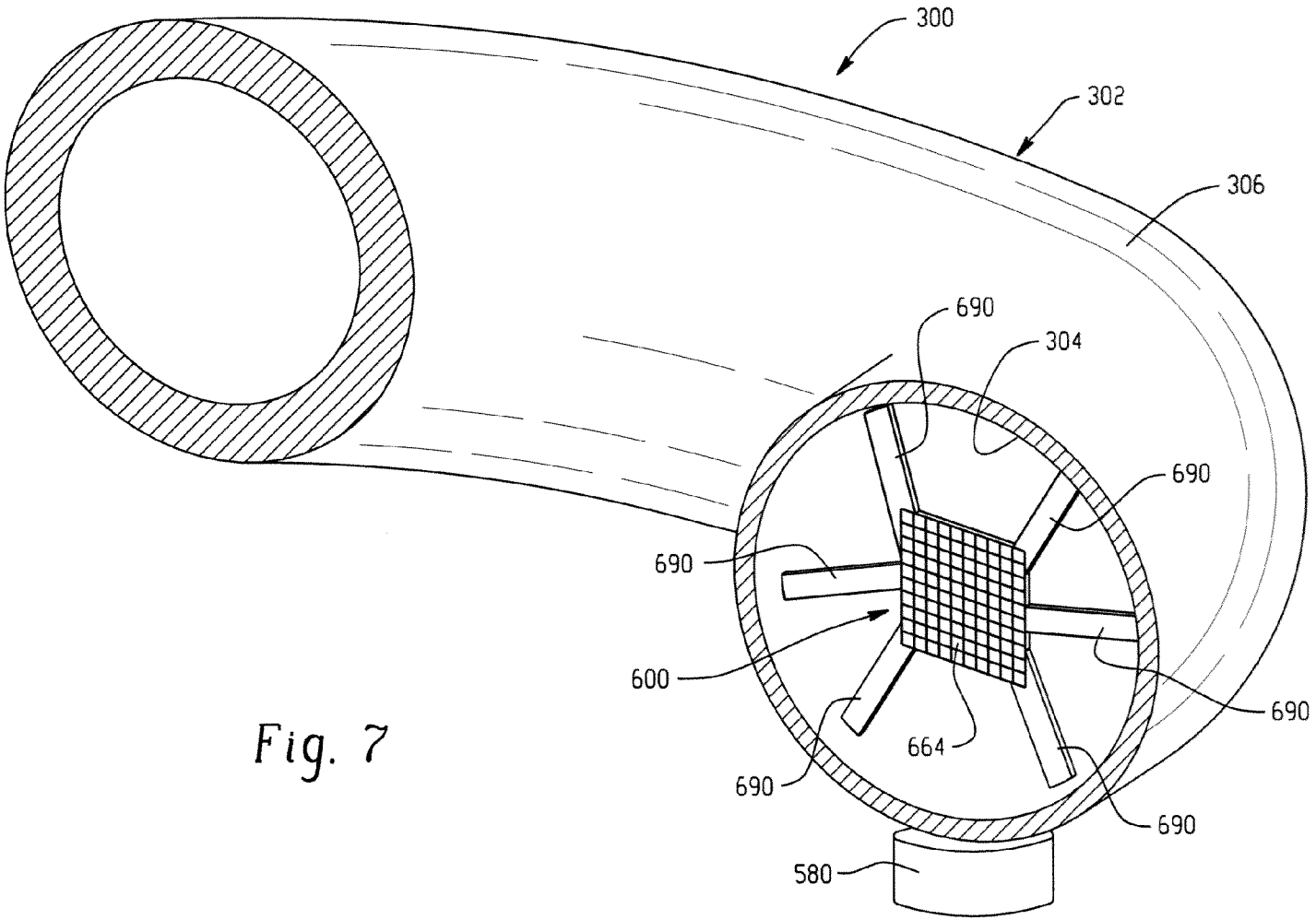
FIG. 7 is an enlarged perspective view in cross-section of a compact fluorescent lamp including an auxiliary amalgam assembly in accordance with an exemplary embodiment.

The associated attachment member 660 is an auxiliary amalgam member. As described previously, the auxiliary amalgam member is a generally planar wire mesh member 664 such as a rectangular or square component attached centrally and perpendicularly within the plurality of holders 690. However, other configurations may prove suitable. In FIG. 7, a permanent magnet 580 is located externally adjacent the discharge tube for positioning the auxiliary amalgam assembly 600 within the discharge chamber wall 304.

The invention has been described with reference to the preferred embodiments. Obviously, modifications and alterations will occur to others upon reading and understanding the preceding detailed description. It is intended that the invention be construed as including all such modifications and alterations.

What is claimed is:

1. A fluorescent lamp comprising:

a discharge tube including a discharge chamber wall; and an auxiliary amalgam assembly held in the discharge tube by a generally C-shaped holder having first and second regions with attaching portions adapted to receive an attachment member, the holder having an opening at each end forming the attaching portions for receipt of a wire or fiber, wherein the generally C-shaped holder has a first dimension prior to disposition in the discharge tube and a greater, second dimension different than the first dimension upon disposition at a desired location in the discharge tube such that the amalgam assembly conforms along a major portion against the discharge chamber wall.

2. The fluorescent lamp of claim 1 wherein the holder is formed of a flexible metal material.

3. A method of positioning an auxiliary amalgam in a fluorescent lamp comprising:

(a) providing a discharge tube having an opening defined by a cross-sectional first dimension;

(b) providing an auxiliary amalgam assembly having a second dimension in a relaxed, unbiased state larger than the first dimension;

(c) reducing the second dimension of the auxiliary amalgam assembly less than the first dimension and holding the auxiliary amalgam assembly to less than the first dimension with a retaining member;

(d) disposing the auxiliary amalgam assembly in the discharge tube; and (e) causing the auxiliary amalgam assembly to increase its second dimension subsequent to disposition in the discharge tube by removing the retaining member such that the auxiliary amalgam assembly conforms along a major portion against the discharge tube.

4. The method of claim 3, wherein the step (e) includes heating in order to release a wire or fiber.

5. A method of positioning an auxiliary amalgam in a fluorescent lamp comprising:

providing a discharge tube having an inner wall forming a chamber; and disposing an auxiliary amalgam including a holder within the discharge tube; and conforming at least a 180 degree portion of the holder to the inner circumferential wall of the discharge tube.

6. The method of claim 5 wherein the disposing step includes the auxiliary amalgam including an attachment member.

7. The method of claim 6 wherein the providing step includes the holder conforming to a portion of the inner surface of the discharge tube.

8. The method of claim 6 wherein the providing step includes the attachment member being an auxiliary amalgam.

* * * * *